US009286882B1

(12) United States Patent
Polakowski et al.

(10) Patent No.: US 9,286,882 B1
(45) Date of Patent: Mar. 15, 2016

(54) SYSTEMS AND METHODS FOR ACTIVE EXHAUST NOISE CANCELLATION

(71) Applicant: Great Lakes Sound & Vibration, Inc., Houghton, MI (US)

(72) Inventors: Stephen E. Polakowski, Atlantic Mine, MI (US); Steven G. Mattson, Houghton, MI (US); Greg A. Kangas, Hancock, MI (US); Zach R. Bustos, Houghton, MI (US)

(73) Assignee: Great Lakes Sound & Vibration, Inc., Houghton, MI (US)

( * ) Notice: Subject to any disclaimer, the term of this patent is extended or adjusted under 35 U.S.C. 154(b) by 334 days.

(21) Appl. No.: 13/789,132

(22) Filed: Mar. 7, 2013

Related U.S. Application Data

(60) Provisional application No. 61/607,983, filed on Mar. 7, 2012.

(51) Int. Cl.

| | |
|---|---|
| ***G10K 11/175*** | (2006.01) |
| ***F01N 1/16*** | (2006.01) |
| ***G10K 11/178*** | (2006.01) |
| ***H04R 3/00*** | (2006.01) |
| ***F01N 1/06*** | (2006.01) |
| *F01N 1/02* | (2006.01) |

(52) U.S. Cl.
CPC ..... *G10K 11/175* (2013.01); *F01N 1/065* (2013.01); *F01N 1/168* (2013.01); *G10K 11/1788* (2013.01); *H04R 3/002* (2013.01); *F01N 1/023* (2013.01); *F01N 2490/12* (2013.01); *G10K 11/178* (2013.01)

(58) Field of Classification Search
CPC ..... H04R 3/002; F01N 1/023; F01N 1/065; F01N 2490/12; F01N 1/168; G10K 11/175; G10K 11/178; G10K 11/1788
See application file for complete search history.

(56) References Cited

U.S. PATENT DOCUMENTS

| | | | | |
|---|---|---|---|---|
| 3,826,870 | A | 7/1974 | Wurm et al. | |
| 4,320,815 | A | 3/1982 | Norris | |
| 5,063,598 | A | 11/1991 | Geddes | |
| 5,097,923 | A | 3/1992 | Ziegler et al. | |
| 5,146,505 | A | 9/1992 | Pfaff et al. | |
| 5,222,148 | A | 6/1993 | Yuan | |
| 5,229,556 | A * | 7/1993 | Geddes | 181/206 |
| 5,255,321 | A | 10/1993 | Murray et al. | |
| 5,319,938 | A * | 6/1994 | Lucas | 62/6 |
| 5,359,662 | A | 10/1994 | Yuan et al. | |
| 5,363,450 | A | 11/1994 | Moody et al. | |
| 5,574,264 | A | 11/1996 | Takemori et al. | |

(Continued)

FOREIGN PATENT DOCUMENTS

WO 2009068186 A1 6/2009

*Primary Examiner* — Davetta W Goins
*Assistant Examiner* — Daniel Sellers
(74) *Attorney, Agent, or Firm* — Andrus Intellectual Property Law, LLP

(57) ABSTRACT

A controlled noise source is for attachment to an exhaust pipe of a vehicle. The noise source comprises an axially compliant member that couples to the exhaust pipe such that an enclosed internal volume of the axially compliant member is in fluid communication with the interior of the exhaust pipe. A dynamic driver is coupled to the axially compliant member. The dynamic driver oscillates the axially compliant member so as to vary the internal volume of the axially compliant member and thereby introduce controlled pressure waves to the interior of the exhaust pipe that counteract sound produced by the engine.

16 Claims, 4 Drawing Sheets

(56) References Cited

U.S. PATENT DOCUMENTS

| | | | | |
|---|---|---|---|---|
| 5,748,749 | A | 5/1998 | Miller et al. | |
| 5,848,168 | A | 12/1998 | Shipps et al. | |
| 6,072,880 | A | 6/2000 | Shipps et al. | |
| 6,234,758 | B1 * | 5/2001 | Pawelski | 417/26 |
| 6,454,047 | B1 | 9/2002 | Galaitsis | |
| 6,595,320 | B2 | 7/2003 | Hwang et al. | |
| 6,601,054 | B1 | 7/2003 | Lo et al. | |
| 6,633,646 | B1 | 10/2003 | Hwang | |
| 6,634,457 | B2 * | 10/2003 | Paschereit et al. | 181/229 |
| 7,021,420 | B2 | 4/2006 | Galaitsis | |
| 7,158,644 | B2 | 1/2007 | Kakuhari et al. | |
| 7,190,796 | B1 * | 3/2007 | Kashani | 381/71.1 |
| 8,144,889 | B2 | 3/2012 | Cheng et al. | |
| 8,270,627 | B2 | 9/2012 | Abe et al. | |
| 2007/0062756 | A1 | 3/2007 | Seibt et al. | |
| 2011/0147116 | A1 | 6/2011 | Olson | |
| 2011/0315472 | A1 | 12/2011 | Ohta et al. | |

* cited by examiner

SYSTEMS AND METHODS FOR ACTIVE EXHAUST NOISE CANCELLATION

CROSS-REFERENCE TO RELATED APPLICATIONS

This application claims priority to and the benefit of U.S. Provisional Application Ser. No. 61/607,983, filed on Mar. 7, 2012, which is hereby incorporated by reference in entirety.

STATEMENT REGARDING FEDERALLY SPONSORED RESEARCH OR DEVELOPMENT

This invention was made with government support under Contract Number W56HZV-12-C-0391 awarded by the U.S. Army. The government has certain rights in the invention.

FIELD

The present disclosure relates to noise control in vehicle exhaust systems. Active exhaust noise cancellation systems and methods are provided to control exhaust noise produced by a vehicle engine.

BACKGROUND

Vehicle engines cause pulsating, high-volume noise which is most noticeably emitted through an exhaust pipe. Such noise is transmitted through the exhaust pipe as a pressure wave. The exhaust noise varies in amplitude and frequency based on the operating characteristics of the vehicle engine. It is possible to actively counteract such exhaust noise with active exhaust noise cancellation systems and methods.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example of the present disclosure, a controlled noise source for attachment to an exhaust pipe of a vehicle engine is provided. The noise source comprises an axially compliant member that couples to the exhaust pipe such that an enclosed internal volume of the axially compliant member is in fluid communication with the interior of the exhaust pipe. A dynamic driver is coupled to the axially compliant member. The dynamic driver oscillates the axially compliant member so as to vary the internal volume of the axially compliant member and thereby introduce controlled pressure waves to the interior of the exhaust pipe that counteract a sound produced by the engine.

In another example of the present disclosure, a system for active cancellation of noise in an exhaust pipe coupled to a vehicle engine is provided. The system comprises an axially compliant member having a first end coupled to the exhaust pipe at a first location. A dynamic driver is coupled to an opposite, second end of the axially compliant member. A controller actuates the dynamic driver to oscillate the axially compliant member so as to introduce controlled pressure waves to an interior of the exhaust pipe that counteract a sound produced by the engine. An error sensor senses residual pressure waves at a second location along the exhaust pipe. The controller receives from the error sensor an error signal related to the residual pressure waves and controls the dynamic driver to adjust a characteristic of the controlled pressure waves so as to minimize the error signal.

In another example of the present disclosure, a method for actively cancelling noise in an exhaust pipe coupled to a vehicle engine is disclosed. The method comprises receiving a first input related to a sound produced by the engine, and actuating a dynamic driver based on the first input. The method further comprises oscillating an axially compliant member with the dynamic driver so as to vary an internal volume of the axially compliant member and thereby introduce controlled pressure waves to an interior of the exhaust pipe that counteract the sound produced by the engine. The method further comprises receiving a second input related to a residual sound not counteracted by the controlled pressure waves, and adjusting a characteristic of a manner in which the dynamic driver oscillates the axially compliant member so as to minimize the residual sound.

BRIEF DESCRIPTION OF THE DRAWINGS

Examples of systems and methods for active exhaust noise cancellation are described with reference to the following Figures. The same numbers are used throughout the Figures to reference like features and like components.

DETAILED DESCRIPTION OF THE DRAWINGS

In the present description, certain terms have been used for brevity, clearness and understanding. No unnecessary limitations are to be implied therefrom beyond the requirement of the prior art because such terms are used for descriptive purposes only and are intended to be broadly construed.

Figure 1:
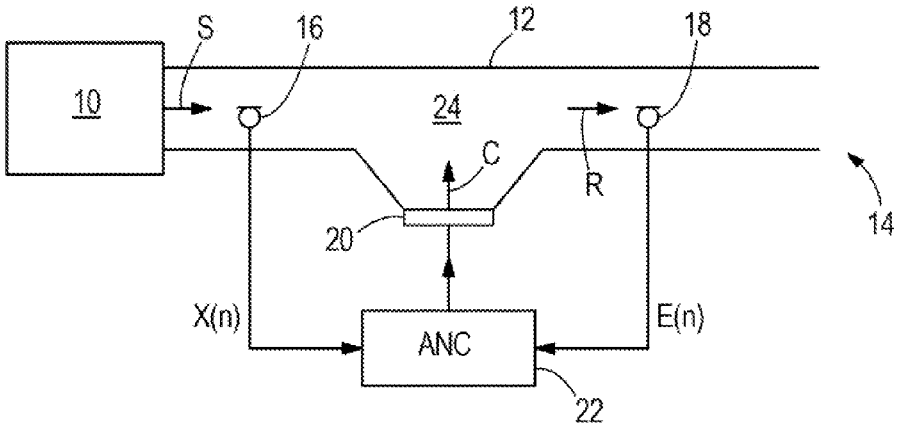
FIG. 1 is a schematic of one example of a control system according to the present disclosure.

FIG. 1 depicts one example of a control system for use with the present disclosure. A noise source, such as an engine 10, emits a sound S through an exhaust pipe 12. The engine 10 is coupled to the exhaust pipe 12 in a known manner, such as through an exhaust manifold that connects cylinders of the engine 10 to the exhaust pipe 12. Exhaust exits a tail end 14 of the exhaust pipe 12 opposite the engine 10. A reference sensor 16 is provided along the exhaust pipe 12. An error sensor 18 is also provided along the exhaust pipe 12. A controlled noise source 20 is provided along the exhaust pipe 12 between the reference sensor 16 and the error sensor 18. A controller 22 that performs active noise control (ANC) is connected in signal communication with each of the reference sensor 16, the error sensor 18, and the controlled noise source 20.

The ANC controller 22 receives a signal X(n) from the reference sensor 16 related to the sound S produced by the engine 10. The ANC controller 22 outputs a control signal Y(n) related to an amplitude, frequency, and timing (phase) of controlled pressure waves C that are to be introduced to the interior 24 of the exhaust pipe 12 via the controlled noise source 20. The sound S produced by the engine 10 is counteracted by the controlled pressure waves C produced by the controlled noise source 20 according to known noise cancellation principles. For example, if the controlled pressure waves C produced by the controlled noise source 20 have the same amplitude and frequency as the sound S produced by the engine 10, but are 180 degrees apart in phase, any residual pressure waves R will be equal to zero. However, due to the varying amplitude and frequency of the sound S produced by the engine 10, the residual pressure waves R will in most cases not have an amplitude of zero. Therefore, the error sensor 18 provides an error signal E(n) related to the residual pressure waves R as an input to the ANC controller 22.

The ANC controller 22 accepts both the reference signal X(n) and the error signal E(n) as inputs and produces the control signal Y(n) as an output. The ANC controller 22 performs an algorithm, more fully described herein below, to adjust the control signal Y(n) so as to minimize the error signal E(n). In other words, the ANC controller 22 seeks to output a control signal Y(n) that will result in controlled pressure waves C that more effectively cancel the sound S and thereby minimize the amplitude of the residual pressure waves R.

Figure 2:
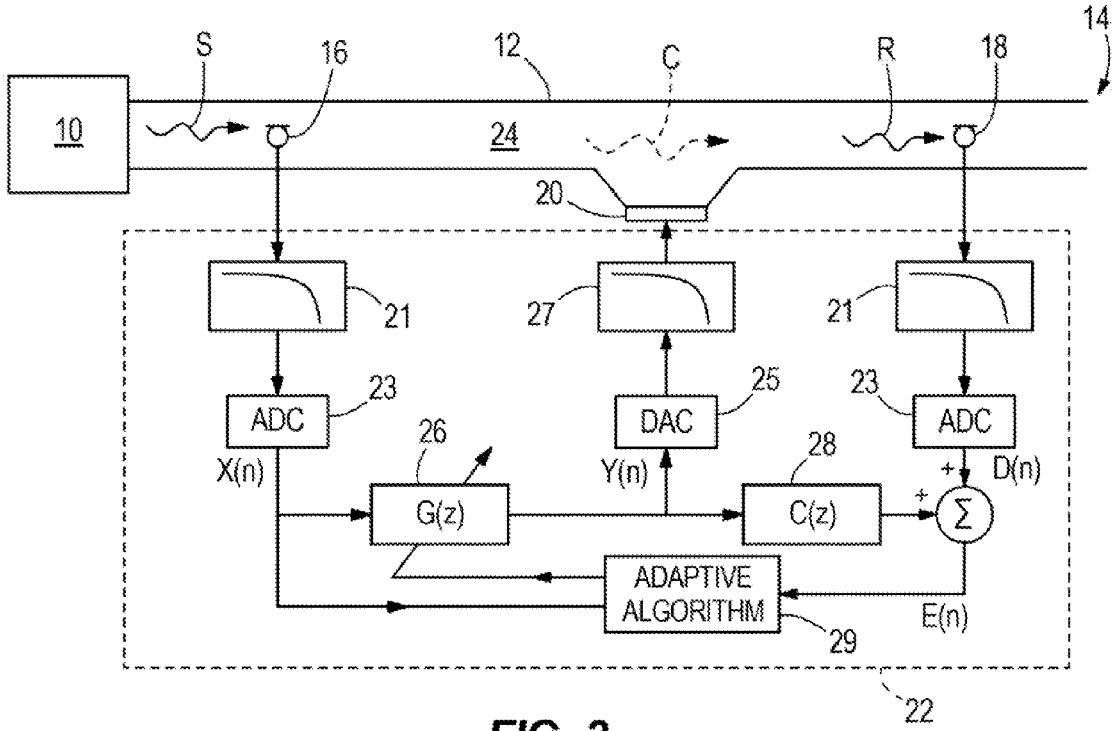
FIG. 2 is a schematic of another example of a control system according to the present disclosure.

FIG. 2 is a schematic that describes the algorithm performed by the ANC controller 22 in more detail. The algorithm performed by the ANC controller 22 approximates how the sound S produced by the engine 10 is modified as it propagates between the reference sensor 16 and the error sensor 18. This is known as the primary path. The ANC controller 22 accepts the reference signal X(n) as an input from the reference microphone 16 and after running it through an anti-aliasing filter 21 and an analog-to-digital converter (ADC) 23, runs it through an adaptive digital filter 26 that approximates the negative of the primary path. The adaptive digital filter 26 produces the control signal Y(n) and routes this through a digital-to-analog converter (DAC) 25 and a reconstruction filter 27 to the controlled noise source 20. The controlled noise source 20 accepts the control signal Y(n) and converts it to motion to create the controlled pressure waves C. Because the adaptive digital filter 26 attempts to approximate the amplitude and frequency of the sound S produced by the engine 10 and to create a signal that is opposite in phase to the wave propagating down the primary path, the controlled pressure waves C that are generated by the controlled noise source 20 are also opposite in phase and cancel the sound S traveling down the exhaust pipe 12.

The control signal Y(n) provided to the controlled noise source 20 is also branched off from the adaptive digital filter 26 and routed through a digital filter 28 along an error path. Meanwhile, an input D(n) related to the residual pressure waves R is sent from the error sensor 18 through an anti-aliasing filter 21 and an analog-to-digital converter 23. The electrical signal D(n) is summed with the filtered control signal from the digital filter 28 to produce the error signal E(n). The error signal E(n) is run through an adaptive algorithm 29 and then provided to the adaptive digital filter 26, which adjusts its representation of the primary path if the error signal E(n) is anything other than zero. In other words, the adaptive digital filter 26 adjusts the control signal Y(n) in an attempt to better approximate the amplitude and frequency of the sound S produced by the engine 10 such that the controlled pressure waves C produced by the controlled noise source 20 more effectively cancel noise in the exhaust pipe 12.

By using an adaptive digital filter 26, rather than a traditional digital filter, to produce the control signal Y(n), the ANC controller 22 is able to better reduce the error signal E(n). The filter coefficients of the adaptive digital filter 26 change over time based on the error signal E(n). In other words, an adaptive algorithm carried out by the adaptive digital filter 26 adjusts the coefficients of the adaptive digital filter 26 iteratively to minimize the power of E(n).

The present inventors have recognized that locating a controlled noise source 20 in proximity to an exhaust pipe 12 requires that the controlled noise source 20 be able to withstand very high temperatures and corrosion inherent in an exhaust system environment. Specifically, the present inventors have recognized difficulties with providing durable hardware capable of withstanding such temperatures and such a corrosive environment. In order to solve this problem, the present inventors have developed the controlled noise source 20 of FIG. 3.

Figure 3:
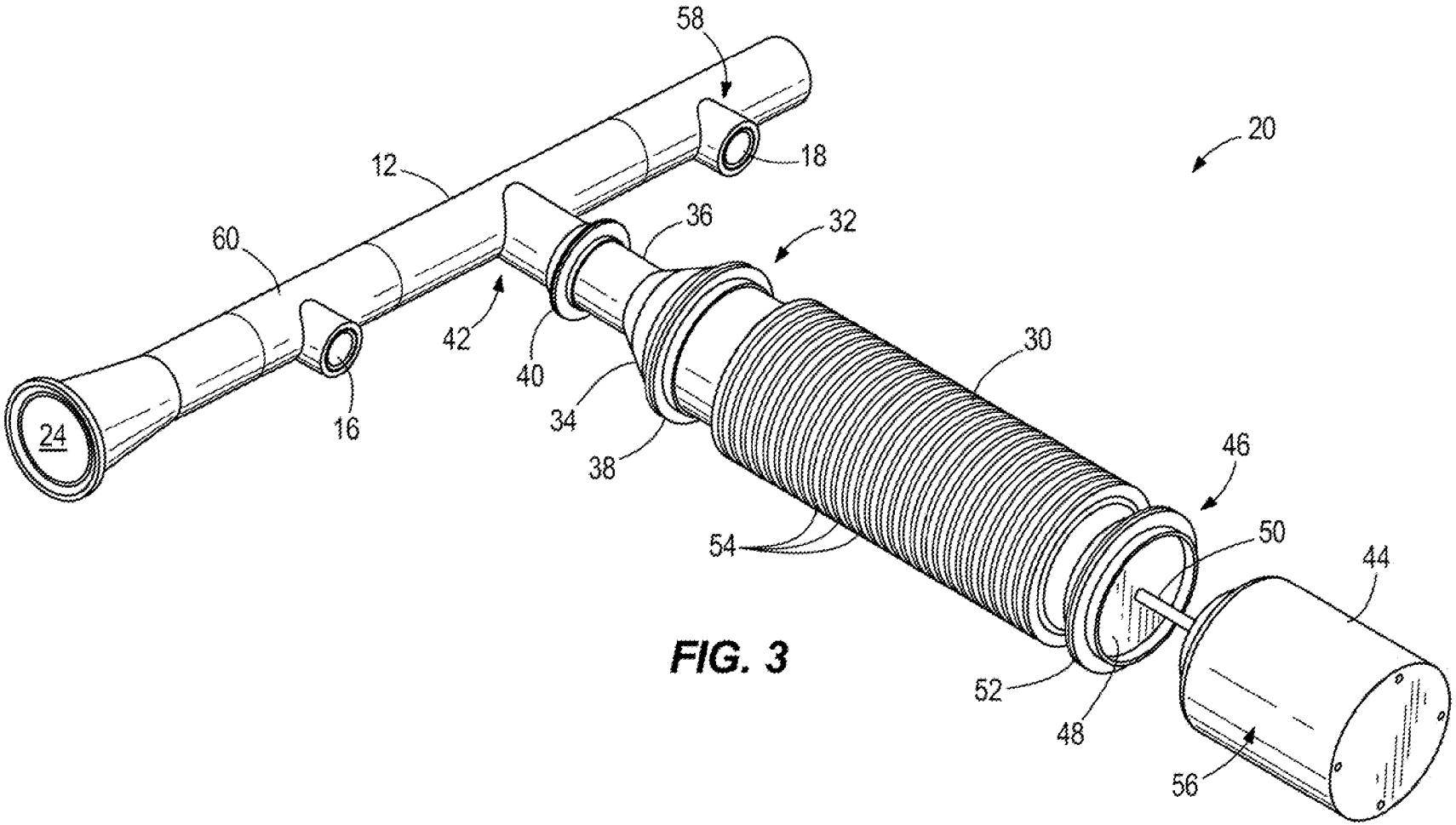
FIG. 3 is an illustration of a controlled noise source according to the present disclosure.

FIG. 3 shows a controlled noise source 20 for attachment to an exhaust pipe 12 of a vehicle engine 10. The controlled noise source 20 comprises an axially compliant member 30. In the example shown, the axially compliant member 30 is a bellows. In other examples, the axially compliant member 30 could be a piston in a cylinder, a sliding joint, a plate supported by radial suspension, or any other axially compliant member capable of mimicking the noise produced by a piston in a cylinder. In one example, the axially compliant member 30 is also radially stiff, durable enough to withstand a number of deflection cycles, and made of a material such as steel that can withstand the exhaust environment. In one embodiment, the axially compliant member 30 is a flexible metal bellows, for example, a bellows having 0.4 millimeter thick steel walls and a pressure rating of up to 85 psi.

The axially compliant member 30 is coupled to the exhaust pipe 12 such that an enclosed internal volume (not shown) of the axially compliant member 30 is in fluid communication with the interior 24 of the exhaust pipe 12. In the example shown, a first end 32 of the axially compliant member 30 is coupled to the exhaust pipe 12 via a conical fitting 34. The conical fitting 34, for example, has a larger diameter where it connects to the first end 32 of the axially compliant member 30 and tapers to a smaller diameter where it couples to a cylindrical fitting 36 that is more suited to the size of the exhaust pipe 12. The first end 32 of the axially compliant member 30 can be connected to the conical fitting 34 with a v-band 38. The conical fitting 34 can be connected to the cylindrical fitting 36 with a smaller v-band 40. In an alternative embodiment, the first end 32 of the axially compliant member 30 is connected to the conical fitting 34 via welding or any other type of fluid-tight connection. The conical fitting 34 can also be connected to the cylindrical fitting 36 by welding or by any other type of fluid-tight connection. The axially compliant member 30 is ultimately coupled to the exhaust pipe 12 at a first location 42 along the exhaust pipe 12. In the example shown, the first end 32 of the axially compliant member 30 is coupled to the exhaust pipe 12 such that the axially compliant member 30 is perpendicular to the exhaust pipe 12.

The controlled noise source 20 further comprises dynamic driver 44 coupled to the axially compliant member 30. In the example of FIG. 3, the dynamic driver 44 is an electrodynamic shaker such as model F4/Z820WA from Wilcoxon Research of Germantown, Md., which provides 10 LBF of force to the bellows. The dynamic driver 44 could alternatively be a linear voice coil provided by BEI Kimco Magnetics of Vista, Calif.; a hydraulic shaker provided by Astre Technologies of Westland, Mich.; or a compression driver such as model number 2490H available from JBL Professional of Northridge, Calif.

The dynamic driver 44 is coupled to a second end 46 of the axially compliant member 30. In the example shown, a rigid membrane 48 is coupled to the second end 46 of the axially compliant member 30. The rigid membrane 48 acts as an end cap to the axially compliant member and is coupled between the dynamic driver 44 and the second end 46 of the axially compliant member 30. The rigid membrane 48 is light weight, and in one example comprises 1.0 millimeter thick steel. The example shown further includes a rod 50 that connects the dynamic driver 44 to the rigid membrane 48. In the example where the dynamic driver is an electrodynamic shaker, the rod 50 connects an internal armature (not shown) of the electrodynamic shaker to the rigid membrane 48. The rigid membrane 48 may be connected to the axially compliant member 30 via a fluid-tight connector, such as a v-band 52. However, any other fluid-tight connection, such as a weld, could be used.

The dynamic driver 44 oscillates the axially compliant member 30 so as to vary the internal volume of the axially compliant member 30 and thereby introduce controlled pressure waves C to the interior 24 of the exhaust pipe 12 that counteract the sound S produced by the engine 10. Because the internal armature of the dynamic driver 44 is connected to the rigid membrane 48, as the dynamic driver 44 is actuated, the rod 50 moves in an oscillatory manner toward and away from the stationary exhaust pipe 12, causing the rigid membrane 48 to oscillate towards and away from the stationary exhaust pipe 12. As the rigid membrane 48 oscillates, it pushes and pulls on the axially compliant member 30. In the example shown, because the axially compliant member 30 is a bellows, it can be moved in such an oscillatory manner due to ribbing 54 provided in its walls. As the axially compliant member 30 oscillates, its internal volume expands and contracts. As the internal volume of the axially compliant member 30 varies, air is forced into and out of the axially compliant member 30. Because the connection, such as the v-band connection 52, between the rigid membrane 48 and the second end 46 of the axially compliant member 30 is a fluid-tight connection, air can only exit the first end 32 of the axially compliant member 30. The air therefore travels through the conical fitting 34 and the cylindrical fitting 36 and into the exhaust pipe 12 at the first location 42. The air enters the exhaust pipe 12 in the form of controlled pressure waves C that correspond to the oscillatory motions of the axially compliant member 30. This connection provides efficient transfer of energy into the exhaust flow as well as broadband performance.

The radial stiffness of the axially compliant member 30 also provides the axially compliant member 30 with the ability to withstand the driving force of the dynamic driver 44. As described above, the internal armature of the dynamic driver 44 pushes and pulls on the second end 46 of the axially compliant member 30 via the rod 50. In order to do so, the dynamic driver 44 should be stationary. For example, the external stator 56 of the dynamic driver 44 can be fixed to the exhaust pipe 12. Alternatively, the external stator 56 can be fixed to a different stationary portion of the vehicle.

Because the controlled noise source 20 is located in an exhaust environment, the dynamic driver 44 will last longer if it is not subjected to increased temperatures and/or corrosive exhaust gas. Therefore, the dynamic driver 44 is isolated from the interior 24 of the exhaust pipe 12. In one example, the rigid membrane 48 that is coupled between the dynamic driver 44 and the second end 46 of the axially compliant member 30 isolates the dynamic driver 44 from the interior 24 of the exhaust pipe 12. This is due to the fact that the fluid-tight connector, such as the v-band 52, couples the rigid membrane 48 to the second end 46 of the axially compliant member 30.

Actuation of the dynamic driver 44 can be, for example, controlled according to the control algorithm described herein above with reference to FIGS. 1 and 2. In one example, a controller, such as the ANC controller 22, actuates the dynamic driver 44 to oscillate the axially compliant member 30 so as to introduce controlled pressure waves C to the interior 24 of the exhaust pipe 12. The ANC controller 22 does so by receiving a signal X(n) regarding the sound S produced by the engine 10 from a reference sensor 16. The ANC controller 22 also receives a signal, such as error signal E(n), from an error sensor 18 that senses residual pressure waves R downstream of the reference sensor 16. The ANC controller 22 processes these signals X(n) and E(n) to produce a signal Y(n) that can change how the dynamic driver 44 oscillates the axially compliant member 30. The signal Y(n) may cause the dynamic driver 44 to change a frequency with which it oscillates the axially compliant member 30. The signal Y(n) may cause the dynamic driver 44 to change an amount by which it moves the axially complaint member 30 towards and away from the exhaust pipe. The signal Y(n) may cause the dynamic driver 44 to change the timing with which it oscillates the axially compliant member 30. In fact, the signal Y(n) may cause the dynamic driver 44 to adjust one, two, or all three of these characteristics of the manner in which it oscillates the axially compliant member 30.

In the example shown in FIG. 3, the axially compliant member 30 is coupled to the exhaust pipe 12 at a first location 42, the error sensor 18 senses residual pressure waves R at a second location 58 along the exhaust pipe 12, and the reference sensor 16 senses sound S at a third location 60 along the exhaust pipe 12. In one example, the first location 42 is between the engine 10 and the second location 58, and the third location 60 is between the engine 10 and first location 42. In one example, the first location 42 corresponds to a location along the exhaust pipe 12 where the sound S is at a pressure maximum, such as at odd multiples of quarter wavelengths of the sound S travelling down the exhaust pipe 12. Such placement of the reference sensor 16, error sensor 18, and axially compliant member 30 is shown in FIGS. 1 and 2.

The sensors 16, 18 are both capable of withstanding high temperature and high intensity signals. For example, the sensors 16, 18 can be probe microphones, such as model number 4182 available from Bruel & Kjaer Sound & Vibration Measurement A/S of Naerum, Denmark. The sensor 16, 18 could also be ultrahigh temperature piezoelectric electric microphones, such as model number M/02/TI-1, available from DJB Instruments of Suffolk, UK. Other suitable sensors include model number 938 from Columbia Research Laboratories, Inc. of Woodlyn, PN; model number 2180C from Dytran Instruments, Inc. of Chatworth, Calif.; or series 171 or 176 pressure sensors from IMI Sensors of Depew, N.Y.

The reference sensor 16 senses the sound S produced by the engine 10 and sends a signal X(n) to the ANC controller 22. The ANC controller 22 actuates the dynamic driver 44 based on this reference signal X(n) and the dynamic driver 44 oscillates the axially compliant member 30 so as to vary the internal volume of the axially compliant member 30. Because the internal volume of the axially compliant member 30 is in fluid communication with the interior 24 of the exhaust pipe 12, such volume variation produces controlled pressure waves C that are introduced to the interior 24 of the exhaust pipe 12 through, for example, the conical fitting 34 and the cylindrical fitting 36. The controlled pressure waves C counteract the sound S produced by the engine 10, as described herein above. In other words, the controlled pressure waves C, if they are equal in amplitude and frequency but opposite in phase to the sound S of the engine 10, will cancel the sound S of the engine 10. The error sensor 18 senses residual pressure waves R at the second location 58 along the exhaust pipe 12 and sends a signal E(n) related to the residual pressure waves R to the ANC controller 22. The ANC controller 22 receives from the error sensor 18 the error signal E(n) related to the residual pressure waves R and controls the dynamic driver 44 to adjust a characteristic of the controlled pressure waves C so as to minimize the error signal E(n). The characteristic can include one or more of the amplitude, frequency, and timing (phase) of the controlled pressure waves. The characteristics of the controlled pressure waves C are adjusted according to the adaptive algorithm described herein above with reference to FIG. 2.

Figure 4:
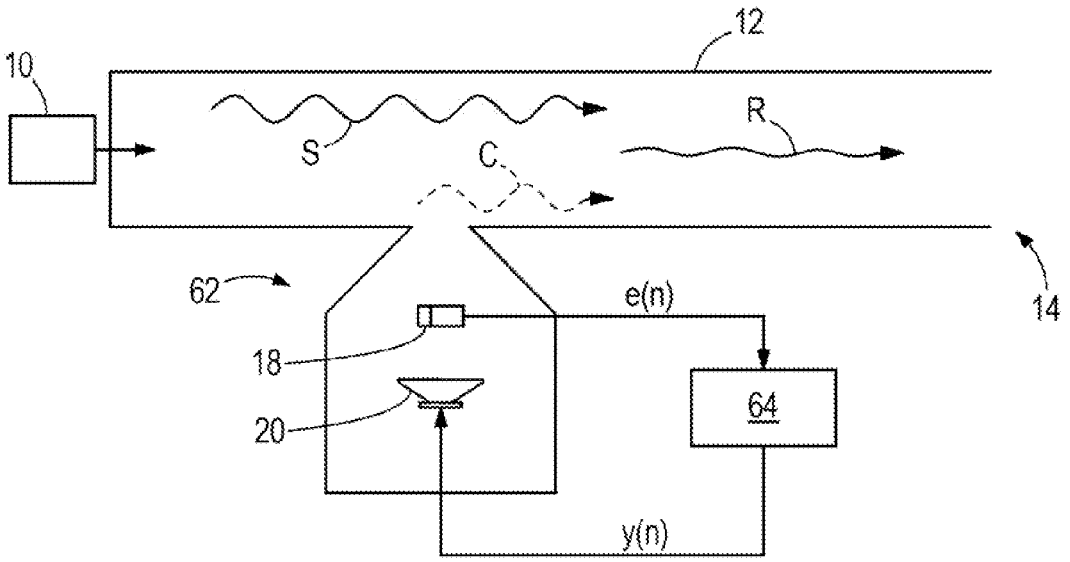
FIG. 4 is a schematic of another example of a control system according to the present disclosure.

Various other control algorithms are possible for cancelling noise in the exhaust pipe 12. For example, in FIG. 4, the error microphone 18 and the controlled noise source 20 are both located at the same location, such as location 62 along the exhaust pipe 12. FIG. 4 depicts a situation in which feedback control uses the single error sensor 18 to produce an error signal E(n). The error signal E(n) is processed by a controller 64 to derive a control signal Y(n). The control signal Y(n) is provided to the controlled noise source 20 to actuate the dynamic driver 44, which in turn varies the internal volume of the axially compliant member 30, and thereby produces controlled pressure waves C in the exhaust pipe 12.

Figure 5:
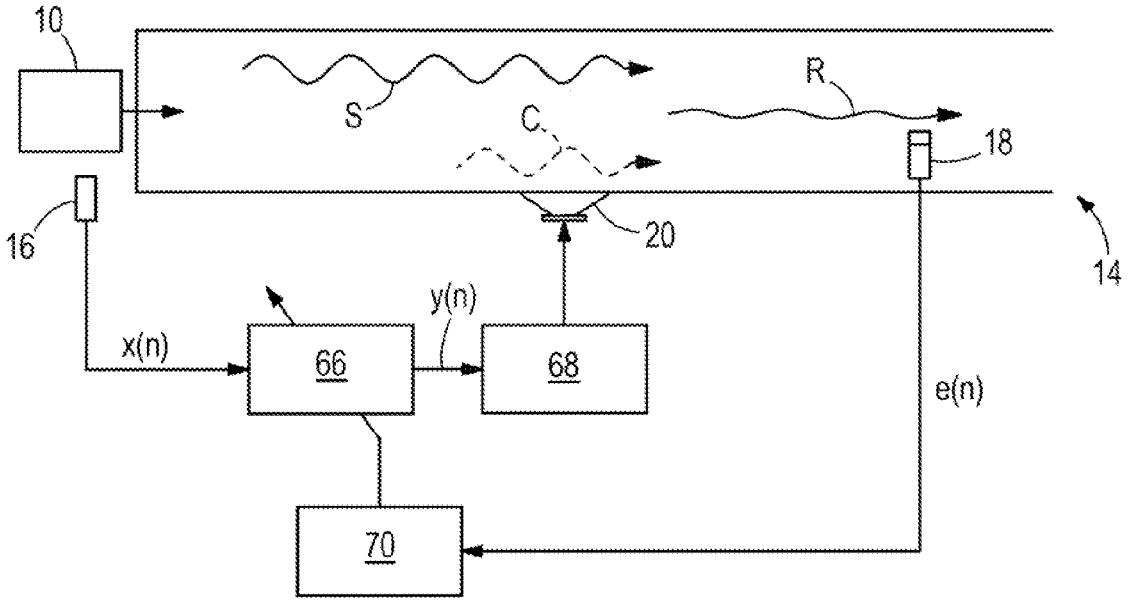
FIG. 5 is an example of another example of a control system according to the present disclosure.

With reference to FIG. 5, another example of a control system is provided. The control system of FIG. 5 utilizes waveform synthesis to provide a pulsed waveform to the controlled noise source 20. The reference sensor 16 of FIG. 5, rather than being an acoustic sensor as in FIGS. 1 and 4, is a speed sensor that senses a speed of the engine 10 as a reference signal X(n). The reference signal X(n) is run through a waveform synthesizer 66 that attempts to predict the waveform of the sound S produced by the engine 10. The waveform synthesizer 66 outputs a control signal Y(n) to a digital-to-analog convertor 68 to control actuation of the controlled noise source 20, according to the description herein above. An error sensor 18 is provided to sense the residual pressure waves R. The error sensor 18 produces an error signal E(n) that is run through an adaptive algorithm 70. The adaptive algorithm 70 optimizes the coefficients of the functions used in the waveform synthesizer 66 so as to optimize such coefficients and better approximate the sound S from the engine 10.

Figure 6:
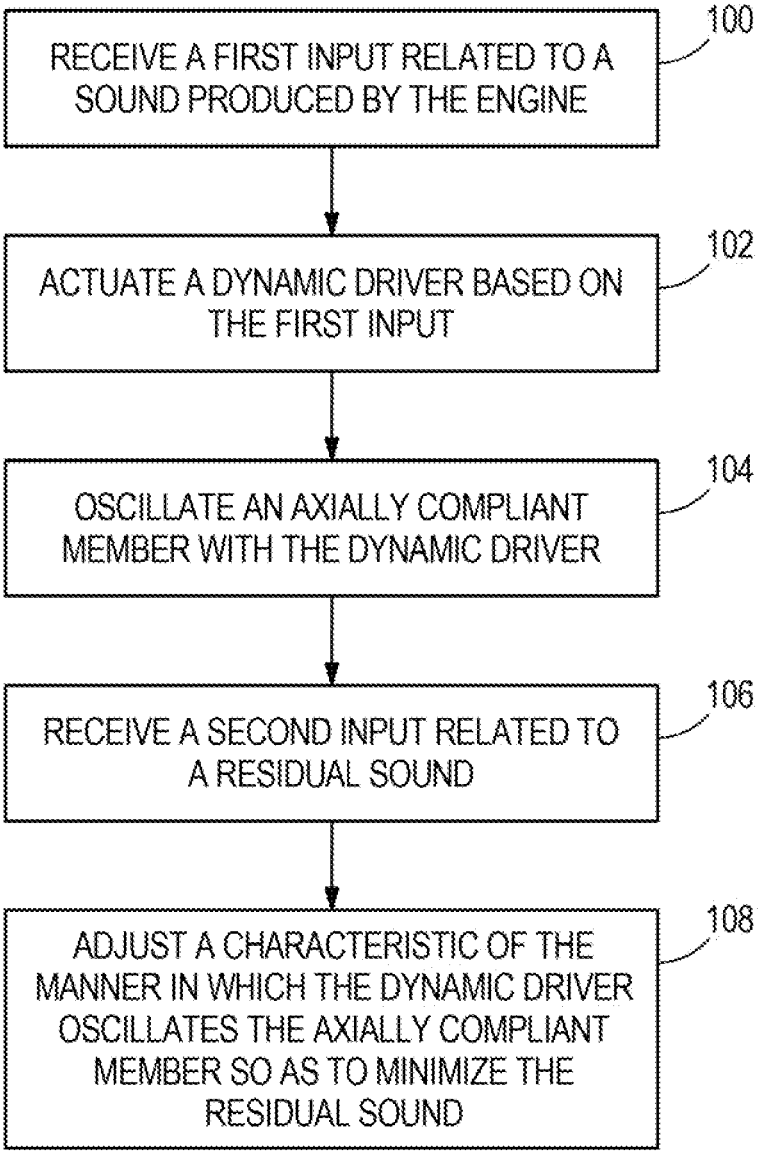
FIG. 6 illustrates one example of a method according to the present disclosure.

Now with reference to FIG. 6, a method for actively cancelling noise in an exhaust pipe 12 coupled to a vehicle engine 10 will be described. As shown at box 100, the method comprises receiving a first input related to a sound S produced by the engine 10. For example, the first input can be a reference signal X(n) provided by a reference sensor 16. In one embodiment, the reference sensor 16 reads a speed of the engine 10. In another embodiment, the reference sensor 16 senses an amplitude and frequency of the sound S produced by the engine 10. As shown at box 102, the method comprises actuating a dynamic driver 44 based on the first input. In one example, the dynamic driver is an electrodynamic shaker. As shown at box 104, the method includes oscillating an axially compliant member 30 with the dynamic driver 44 so as to vary an internal volume of the axially compliant member 30 and thereby introduce controlled pressure waves C to an interior 24 of the exhaust pipe 12 that counteract the sound S produced by the engine 10. In one embodiment, the axially compliant member is a bellows. As shown at box 106, the method comprises receiving a second input related to a residual sound R not counteracted by the controlled pressure waves C. In one example, the second input is an error signal E(n) provided by an error sensor 18. As shown at box 108, the method comprises adjusting a characteristic of a manner in which the dynamic driver 44 oscillates the axially compliant member 30 so as to minimize the residual sound R. The characteristic can include the frequency with which the dynamic driver 44 oscillates the axially compliant member, the amount by which the dynamic driver 44 moves the axially complaint member 30 towards and away from the exhaust pipe 12, and/or the timing with which the dynamic driver oscillates the axially compliant member 30.

In the above description certain terms have been used for brevity, clearness and understanding. No unnecessary limitations are to be implied therefrom beyond the requirement of the prior art because such terms are used for descriptive purposes only and are intended to be broadly construed. The different systems and methods described herein above may be used in alone or in combination with other systems and methods. Various equivalents, alternatives and modifications are possible within the scope of the appended claims. Each limitation in the appended claims is intended to invoke interpretation under 35 USC §112, sixth paragraph only the terms "means for" or "step for" are explicitly recited in the respective limitation. While each of the method claims includes a specific series of steps for accomplishing certain control system functions, the scope of this disclosure is not intended to be bound by the literal order or literal content of steps described herein, and non-substantial differences or changes still fall within the scope of the disclosure.

What is claimed is:

1. A controlled noise source for attachment to an exhaust pipe of a vehicle engine, the noise source comprising:

a bellows having a first end that couples to the exhaust pipe such that an enclosed internal volume of the bellows is in fluid communication with an interior of the exhaust pipe; and a dynamic driver coupled to an opposite, second end of the bellows;

wherein the dynamic driver oscillates the bellows so as to vary the internal volume of the bellows and thereby introduce controlled pressure waves to the interior of the exhaust pipe that counteract a sound produced by the engine;

wherein the dynamic driver pushes on the bellows to contract the bellows and push air into the interior of the exhaust pipe, and pulls on the bellows to expand the bellows and pull air out of the interior of the exhaust pipe; and wherein a controller in signal communication with the dynamic driver controls one or more of a frequency, an amount, and a timing with which the dynamic driver contracts and expands the bellows so that the controlled pressure waves are actively generated to counteract the sound produced by the engine.

2. The noise source of claim 1, wherein the bellows is radially stiff.

3. The noise source of claim 1, further comprising a rigid membrane coupled to the second end of the bellows, wherein the rigid membrane is coupled between the dynamic driver and the second end of the bellows.

4. The noise source of claim 3, wherein the dynamic driver is an electrodynamic shaker.

5. The noise source of claim 4, further comprising a rod that connects an internal armature of the electrodynamic shaker to the rigid membrane.

6. The noise source of claim 3, further comprising a fluid-tight connector that couples the rigid membrane to the second end of the bellows.

7. A system for active cancellation of noise in an exhaust pipe coupled to a vehicle engine, the system comprising:

a bellows having a first end coupled to the exhaust pipe at a first location;

a dynamic driver coupled to an opposite, second end of the bellows;

a controller that actuates the dynamic driver to oscillate the bellows so as to introduce controlled pressure waves to an interior of the exhaust pipe that counteract a sound produced by the engine; and an error sensor that senses residual pressure waves at a second location along the exhaust pipe;

wherein the bellows has an internal volume in fluid communication with the interior of the exhaust pipe, and wherein oscillation of the bellows varies the internal volume of the bellows by pushing to contract and pulling on to expand the bellows so as to produce the controlled pressure waves by pushing and pulling air into and out of the interior of the exhaust pipe; and wherein the controller receives from the error sensor an error signal related to the residual pressure waves and controls the dynamic driver to adjust a characteristic of the controlled pressure waves, such as by adjusting one or more of a frequency, an amount, and a timing with which the dynamic driver contracts and expands the bellows, so that the controlled pressure waves are actively adjusted to counteract the sound produced by the engine so as to minimize the error signal.

8. The system of claim 7, wherein the dynamic driver is isolated from the interior of the exhaust pipe.

9. The system of claim 8, further comprising a rigid membrane coupled between the dynamic driver and the second end of the bellows so as to isolate the dynamic driver from the interior of the exhaust pipe.

10. The system of claim 9, wherein the dynamic driver is an electrodynamic shaker.

11. The system of claim 10, further comprising a rod that connects an internal armature of the electrodynamic shaker to the rigid membrane.

12. The system of claim 7, wherein the first location is between the engine and the second location.

13. The system of claim 12, further comprising a reference sensor that senses the sound produced by the engine, the reference sensor being located at a third location along the exhaust pipe that is between the engine and the first location, wherein the controller actuates the dynamic driver based on a reference signal from the reference sensor.

14. The system of claim 7, wherein the first end of the bellows is coupled to the exhaust pipe such that the bellows is perpendicular to the exhaust pipe.

15. A method for actively cancelling noise in an exhaust pipe coupled to a vehicle engine, the method comprising:

receiving a first input related to a sound produced by the engine;

actuating a dynamic driver based on the first input;

oscillating a bellows with the dynamic driver so as to vary an internal volume of the bellows by pushing to contract and pulling on to expand the bellows and thereby introduce controlled pressure waves to an interior of the exhaust pipe by pushing and pulling air into and out of the interior of the exhaust pipe, which controlled pressure waves counteract the sound produced by the engine;

receiving a second input related to a residual sound not counteracted by the controlled pressure waves; and adjusting a characteristic of a manner in which the dynamic driver oscillates the bellows, such as at least one of a frequency, an amount, and a timing with which the dynamic driver contracts and expands the bellows so that the controlled pressure waves are actively adjusted to counteract the sound produced by the engine so as to minimize the residual sound.

16. The method of claim 15, wherein the dynamic driver is an electrodynamic shaker.

* * * * *